US012059059B2

(12) United States Patent
Kuewa

(10) Patent No.: US 12,059,059 B2
(45) Date of Patent: Aug. 13, 2024

(54) SPORTS FOOTWEAR ASSEMBLY

(71) Applicant: Alex Kuewa, Waipahu, HI (US)

(72) Inventor: Alex Kuewa, Waipahu, HI (US)

( * ) Notice: Subject to any disclaimer, the term of this patent is extended or adjusted under 35 U.S.C. 154(b) by 70 days.

(21) Appl. No.: 18/090,761

(22) Filed: Dec. 29, 2022

(65) Prior Publication Data

US 2024/0215687 A1 Jul. 4, 2024

(51) Int. Cl.
*A43C 15/16* (2006.01)
*A43B 13/26* (2006.01)

(52) U.S. Cl.
CPC ..... *A43C 15/161* (2013.01); *A43B 13/26* (2013.01); *A43C 15/168* (2013.01)

(58) Field of Classification Search
CPC ..... A43C 15/16; A43C 15/161; A43C 15/168; A43C 15/02; A43B 15/185
See application file for complete search history.

(56) References Cited

U.S. PATENT DOCUMENTS

| | | | | | |
|---|---|---|---|---|---|
| 2,459,455 | A * | 1/1949 | Robinson | A43C 15/02 | 36/7.7 |
| 2,523,652 | A * | 9/1950 | Dowd | A43C 15/161 | 411/141 |
| 3,327,412 | A * | 6/1967 | Wilmanns | A43C 15/161 | 12/142 P |
| 3,566,489 | A * | 3/1971 | Morley | A43C 15/161 | 36/67 D |
| 3,876,176 | A * | 4/1975 | Morin | B29D 35/061 | 249/134 |
| 4,274,211 | A * | 6/1981 | Funck | A43B 13/223 | 36/32 R |
| 6,021,590 | A * | 2/2000 | Morimoto | A43C 15/168 | 36/134 |
| 6,260,292 | B1 * | 7/2001 | Swedick | A43C 15/161 | 36/134 |
| 6,421,937 | B2 | 7/2002 | Heller | | |
| 6,601,322 | B2 | 8/2003 | Hsiao | | |
| 7,774,958 | B2 | 8/2010 | Carruthers | | |
| 9,161,594 | B2 | 10/2015 | Jungkind | | |
| D775,803 | S | 1/2017 | Fisher | | |
| 2004/0187356 | A1 * | 9/2004 | Patton | A43D 100/14 | 36/134 |
| 2018/0228251 | A1 * | 8/2018 | Sussmann | A43C 15/168 | |

FOREIGN PATENT DOCUMENTS

| | | |
|---|---|---|
| WO | WO2011023780 | 3/2011 |

* cited by examiner

*Primary Examiner* — Ted Kavanaugh

(57) ABSTRACT

A sports footwear assembly for providing a removable bracket for a shoe to which cleats are removably attached includes a shoe with a rubber sole and a bracket for attaching to the sole which is rigid. A plurality of holders is coupled to the bracket, each of which is shaped to contain a plurality of cleats. Each cleat is removably coupled to one of the holders and extends downwardly to insert into a ground surface.

10 Claims, 9 Drawing Sheets

SPORTS FOOTWEAR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to sports shoes and more particularly pertains to a new sports shoe for providing a removable bracket for a shoe to which cleats are removably attached.

(2) Description of Related Art Including Information Disclosed Under 37 CFR 1.97 and 1.98

The prior art relates to sports shoes with cleats that removably attach to the sports shoe. Many of these devices require a tool to be inserted into the sole of the shoe to actuate a locking mechanism to release each of the cleats from the shoe. One device includes a locking mechanism with a button that extends downwardly from the sole which presses a ball into the sole to retain the cleat in the shoe. The button is shaped such that, when it is pressed upwardly into the shoe, the ball is permitted to move away from the sole, releasing the cleat. However, the prior art is silent as to an intermediate rigid bracket that attaches to a resiliently deformable sole of the shoe and releasably attaches to the cleats.

BRIEF SUMMARY OF THE INVENTION

An embodiment of the disclosure meets the needs presented above by generally comprising a shoe with a sole that comprises a resiliently deformable and slip resistant material. A bracket is coupled to the sole and extends downwardly from the sole. The bracket comprises a rigid material which is more rigid than the sole. The bracket also has a base wall extending along a bottom surface of the sole. Each one of a plurality of holders is coupled to the base wall. Each holder comprises an elongated tubular wall which extends upwardly from the base wall of the bracket. The base wall has a plurality of holes, each of which aligns with an associated holder of the plurality of holders to define a socket of the associated holder. Each cleat of a plurality of cleats is insertable into the socket of a corresponding one of the plurality of holders. Each cleat extends downwardly for inserting into a ground surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
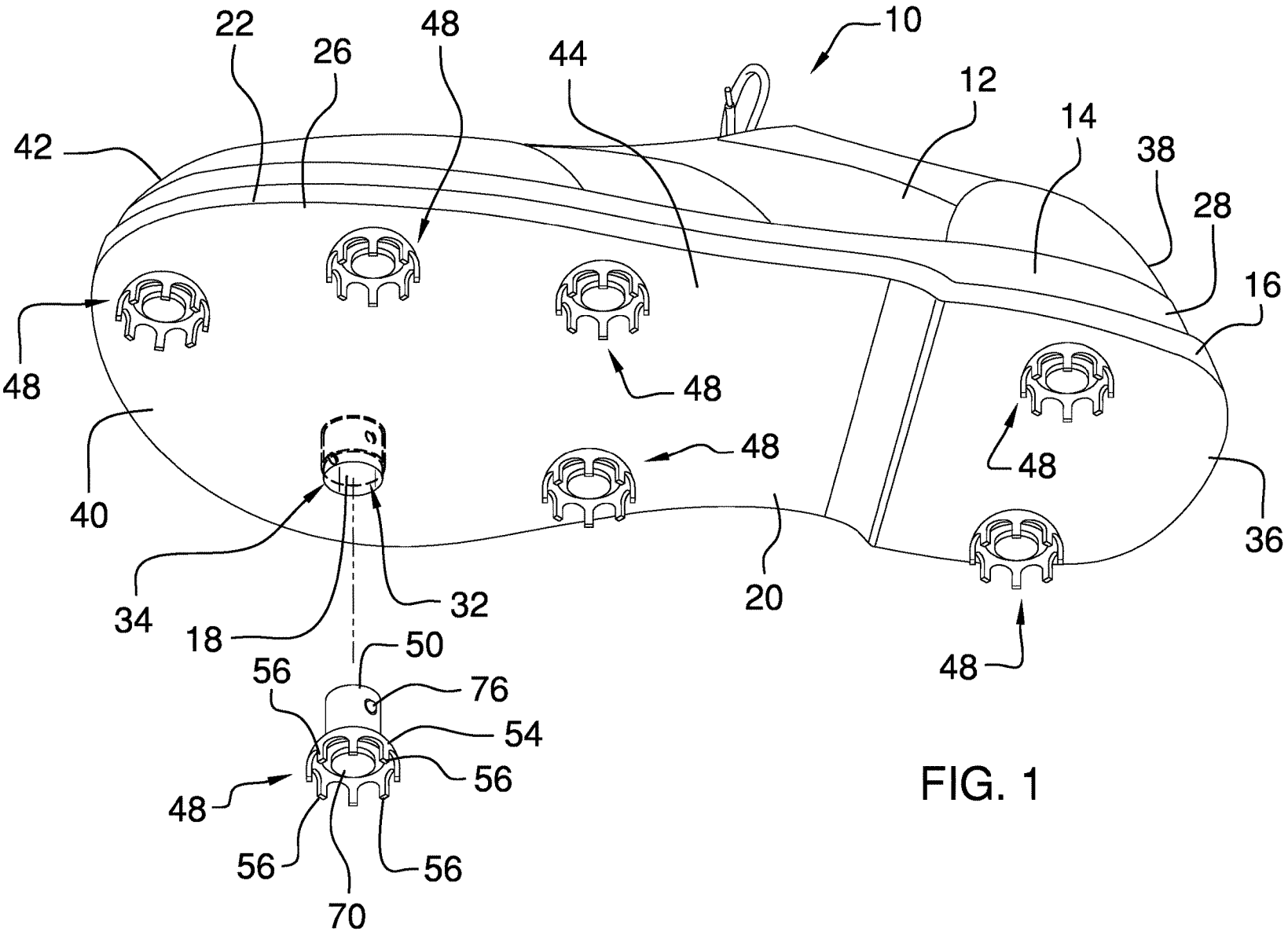
FIG. 1 is a partially exploded bottom side perspective view of a sports footwear assembly according to an embodiment of the disclosure.
Figure 2:
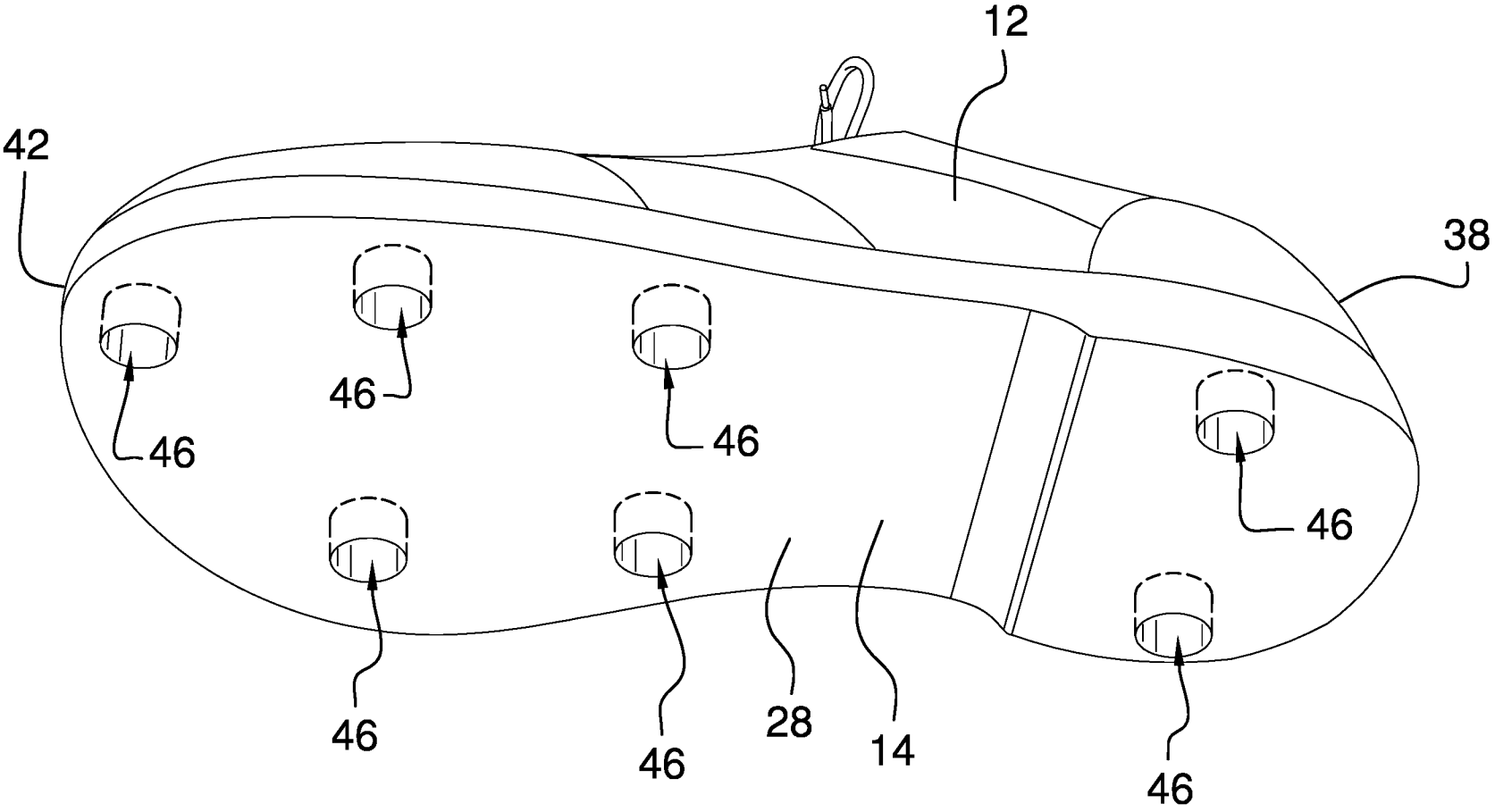
FIG. 2 is a bottom side perspective view of a shoe according to an embodiment of the disclosure.
Figure 3:
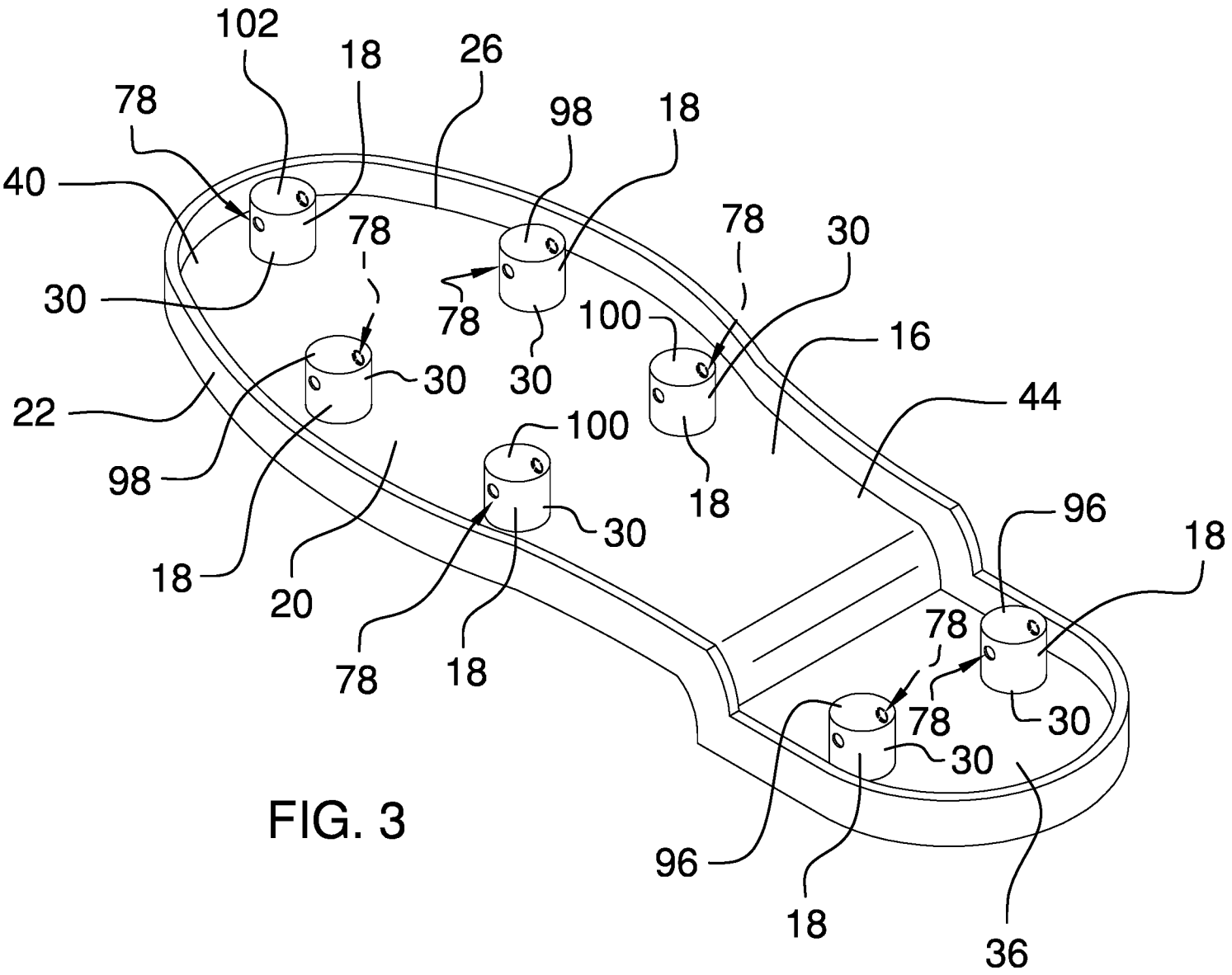
FIG. 3 is a top rear side perspective view of a bracket and a plurality of holders according to an embodiment of the disclosure.
Figure 4:
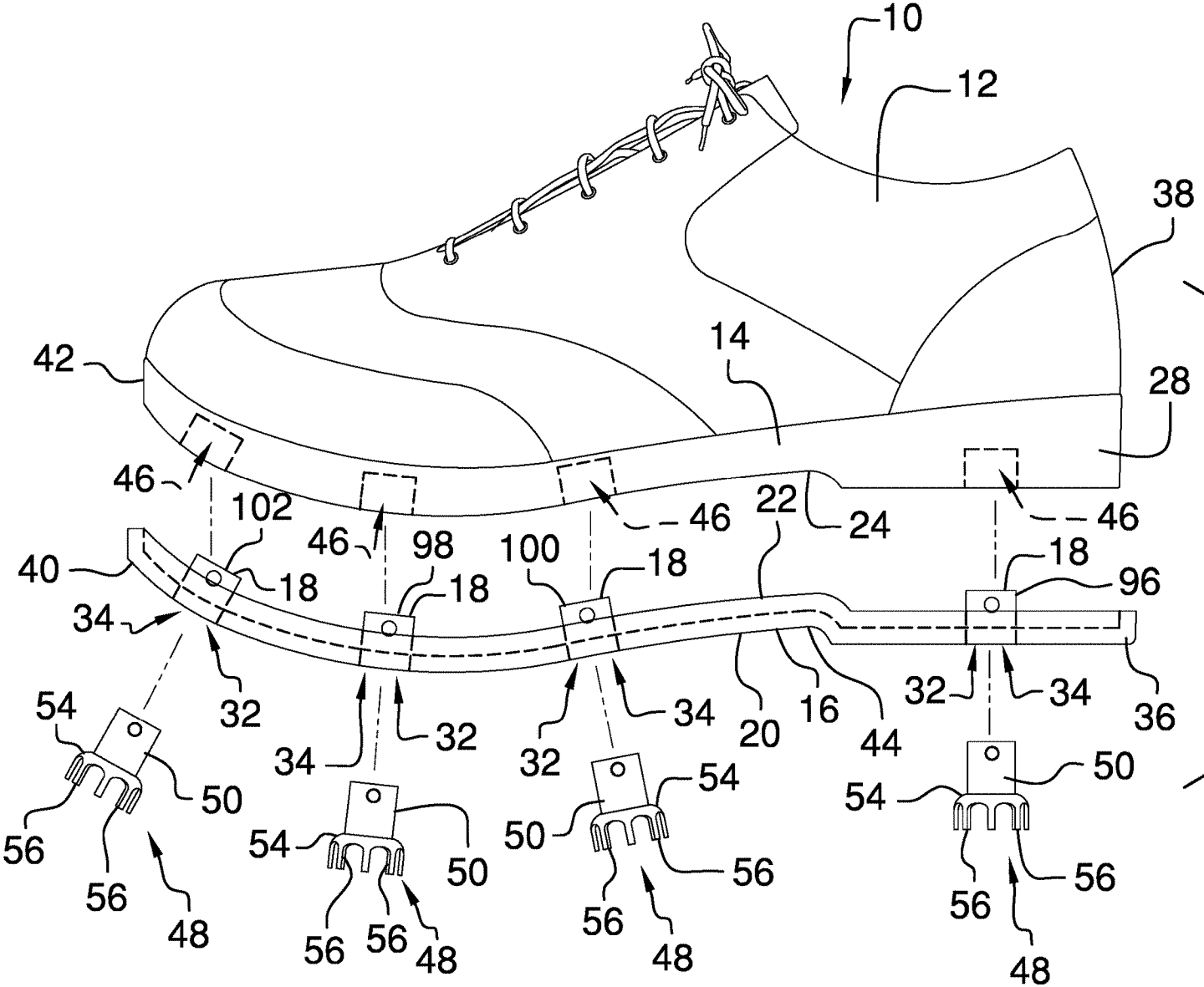
FIG. 4 is an exploded side view of an embodiment of the disclosure.
Figure 5:
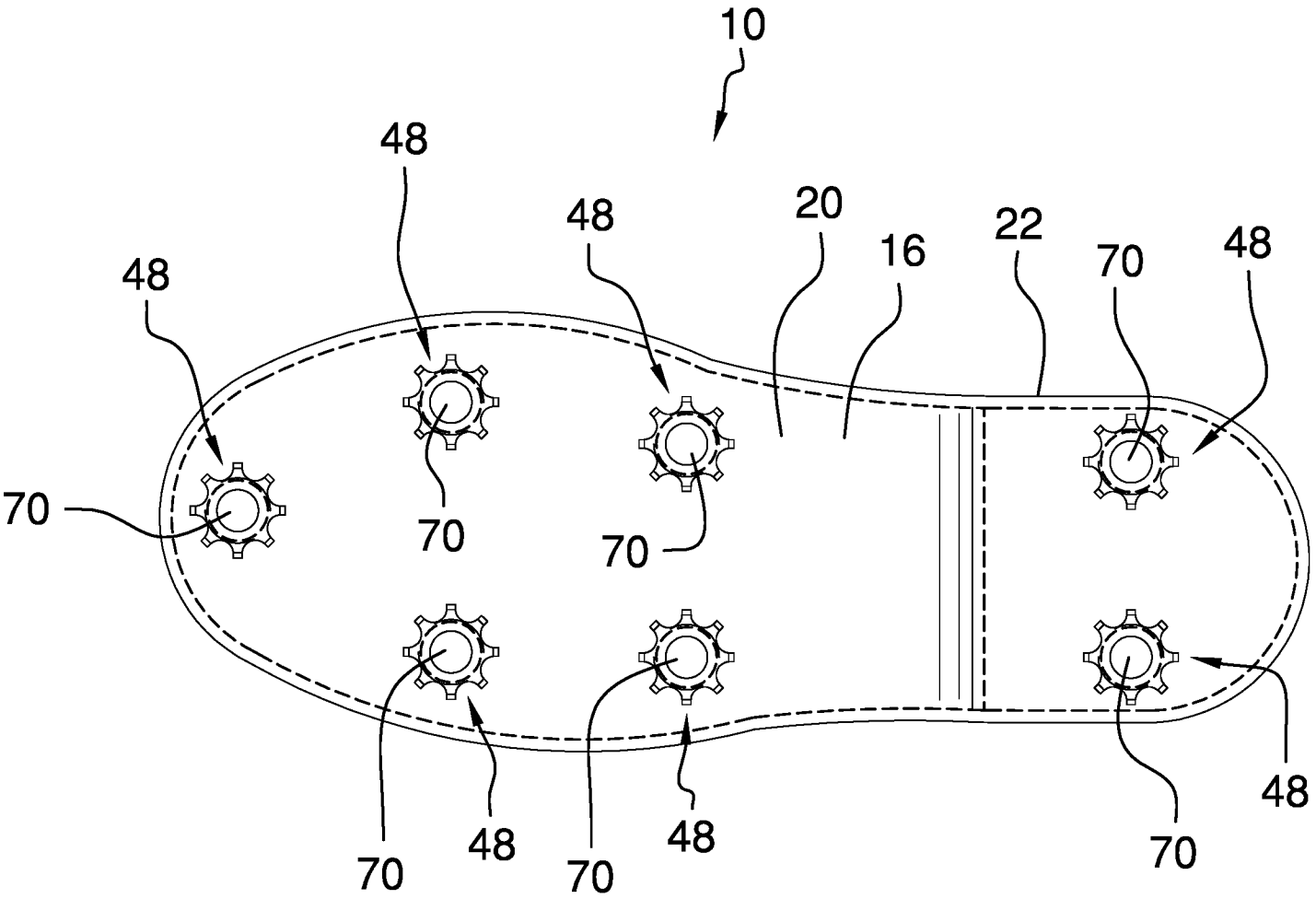
FIG. 5 is a bottom view of an embodiment of the disclosure.
Figure 6:
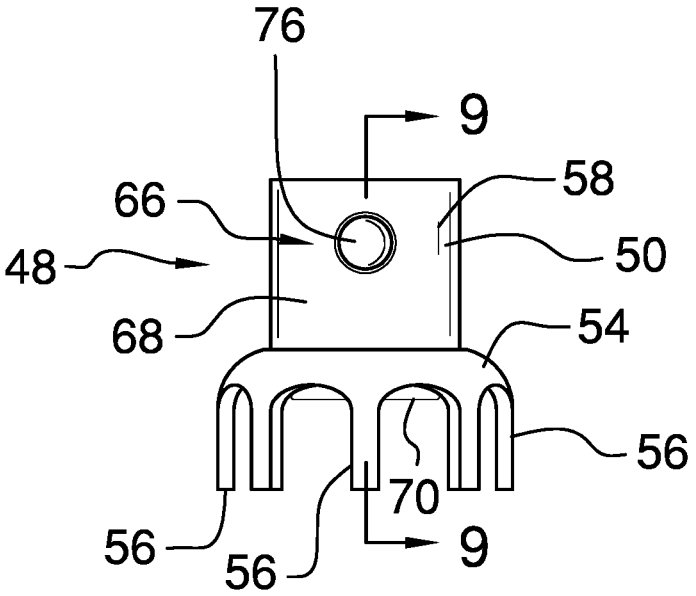
FIG. 6 is a front detail view of a cleat according to an embodiment of the disclosure.
Figure 7:
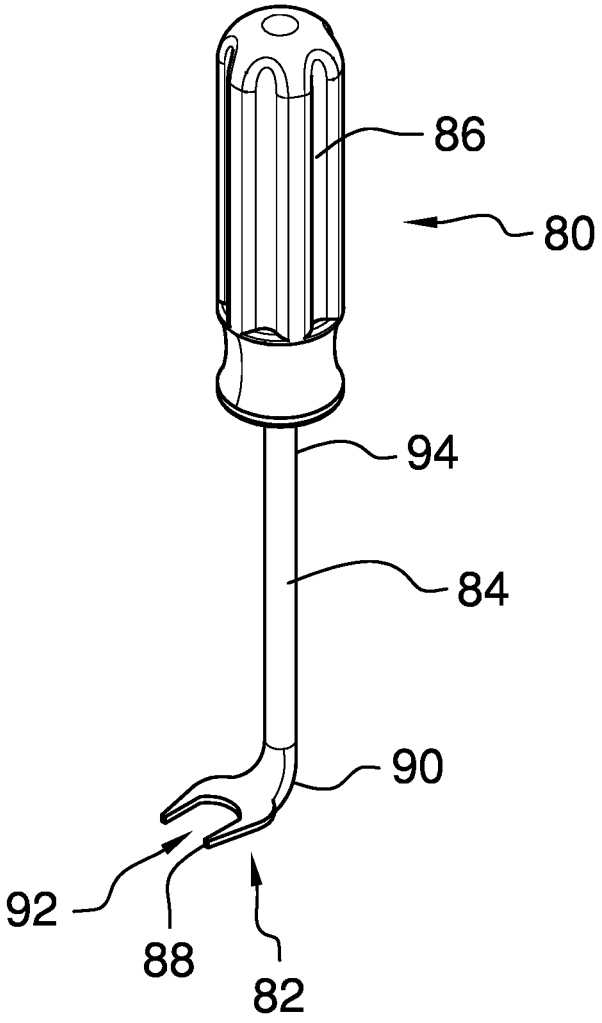
FIG. 7 is a perspective detail view of a removal tool according to an embodiment of the disclosure.
Figure 8:
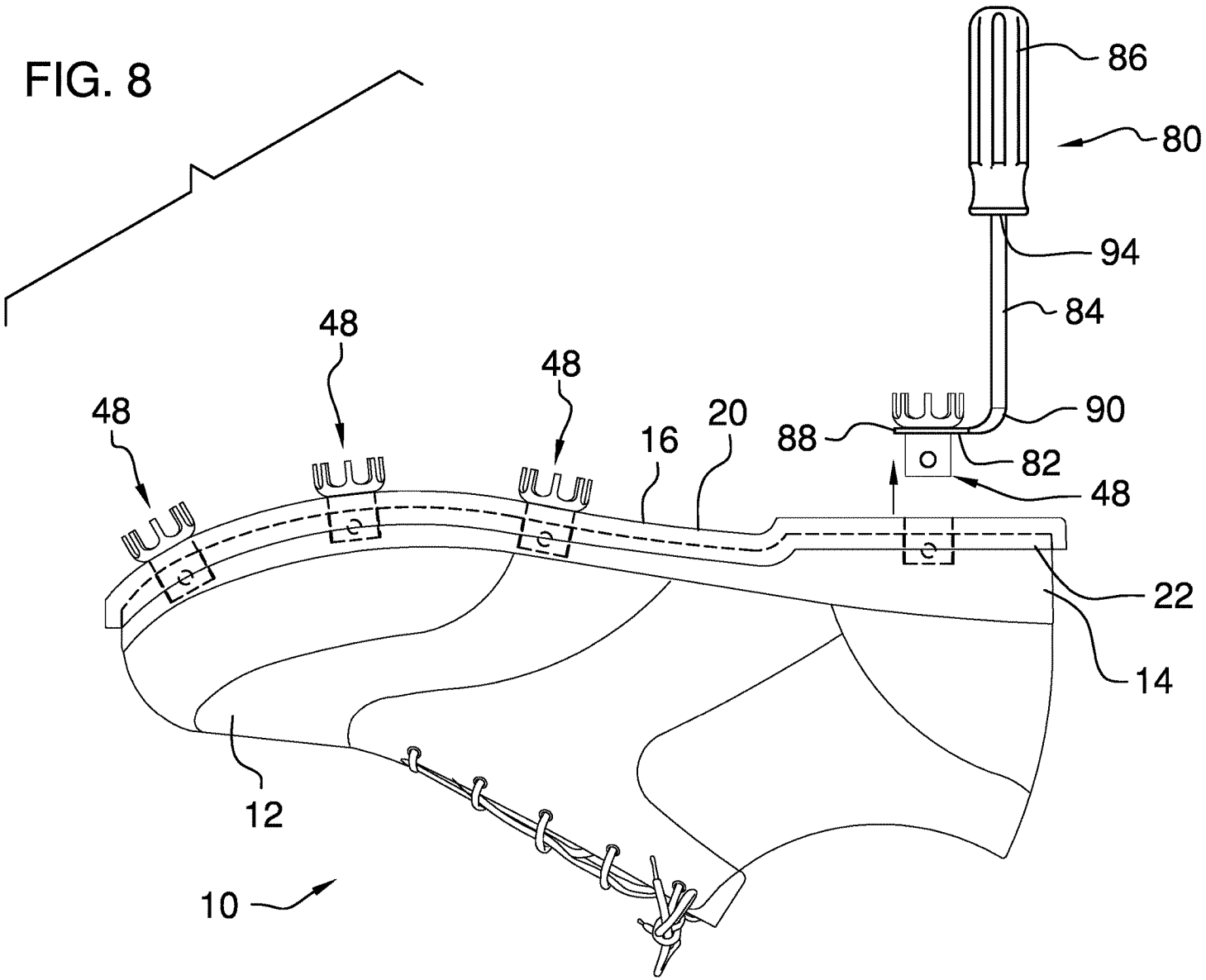
FIG. 8 is a side in-use view of an embodiment of the disclosure.
Figure 9A:
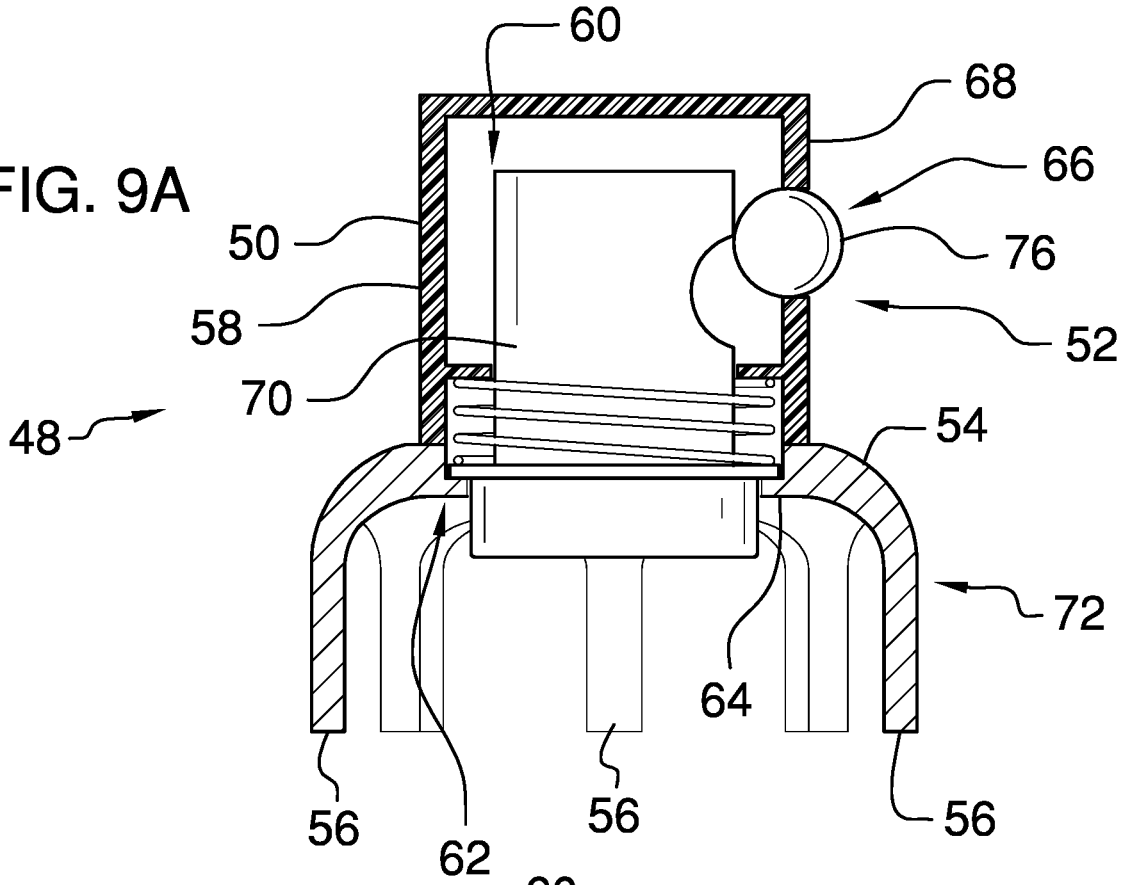
FIG. 9A is a cross-section view of a cleat according to an embodiment of the disclosure taken from arrows 9-9 in FIG. 6. A button in this figure is in an engagement position.
Figure 9B:
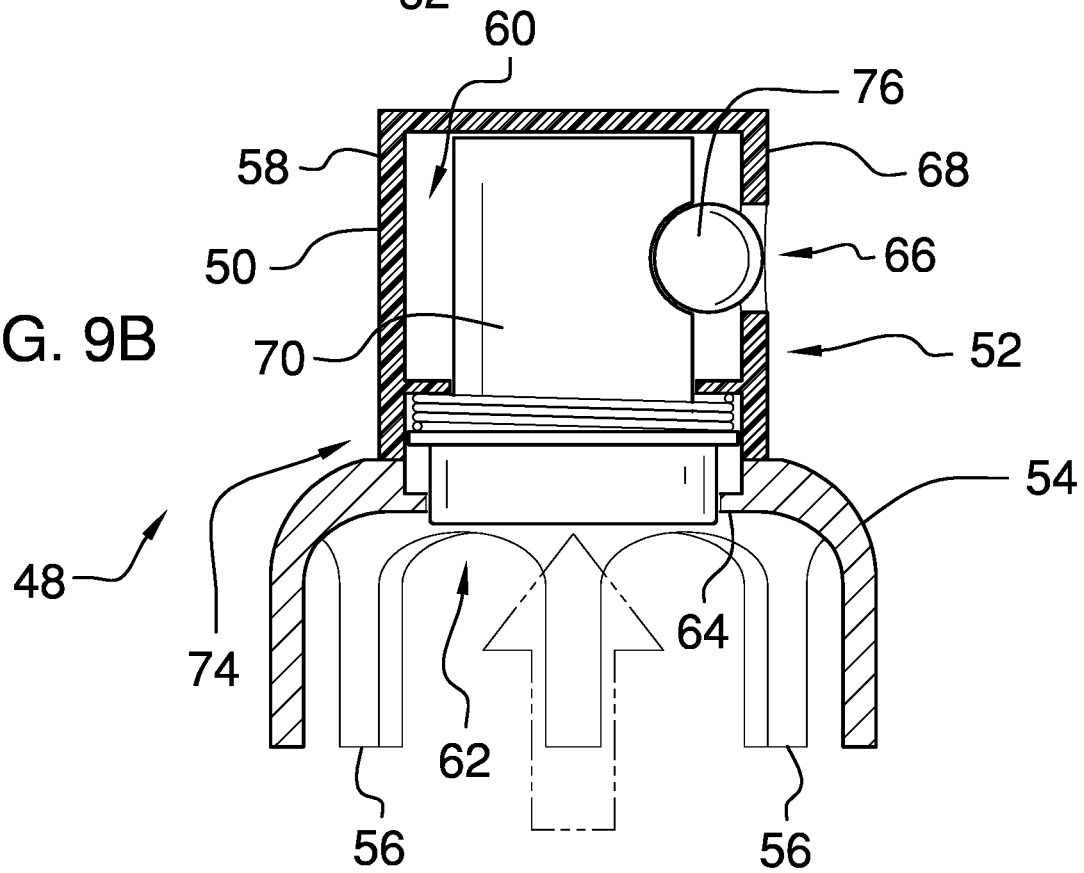
FIG. 9B is a cross-section view of a cleat according to an embodiment of the disclosure taken from arrows 9-9 in FIG. 6. A button in this figure is in a release position.

With reference now to the drawings, and in particular to FIGS. 1 through 9B thereof, a new sports shoe embodying the principles and concepts of an embodiment of the disclosure and generally designated by the reference numeral 10 will be described.

As best illustrated in FIGS. 1 through 9B, the sports footwear assembly 10 generally comprises a shoe 12 with a sole 14 that comprises a resiliently deformable and slip resistant material. The sole 14 comprises rubber but may comprise another elastomer or other material which resiliently deforms to cushion a user while the user walks. A bracket 16 is coupled to the sole 14 and extends downwardly from the sole 14. The bracket 16 comprises a rigid material which is more rigid than the sole 14. A plurality of holders 18 is coupled to the bracket 16, and the bracket 16 is rigid to resist deflection and maintain each of the holders 18 in fixed positions relative to each other. The bracket 16 has a base wall 20 and a lip 22. The base wall 20 extends along a bottom surface 24 of the sole 14, and the lip 22 is coupled to a peripheral edge 26 of the base wall 20. The lip 22 extends upwardly from the base wall 20 to engage a peripheral surface 28 of the sole 14 such that the bracket 16 is removable from the sole 14. The lip 22 frictionally engages the slip resistant sole 14 but may latch onto the sole 14.

Each holder 18 of the plurality of holders 18 comprises an elongated tubular wall 30 which extends upwardly from the base wall 20. The base wall 20 has a plurality of holes 32 which each align with an associated holder 18 of the plurality of holders 18 to define a socket 34 of the associated holder 18. The base wall 20 has a heel portion 36 positioned at a heel end 38 of the shoe 12, a toe portion 40 is positioned at a toe end 42 of the shoe 12, and a central portion 44 positioned between the heel portion 36 and the toe portion 40. The plurality of holders 18 includes a pair of heel holders 96, a pair of front holders 98, a pair of middle holders 100, and a toe holders 102. Each heel holder 96 is positioned on the heel portion 36 of the base wall 20 and is laterally spaced with respect to each other. Each front holder 98 and each middle holder 100 is positioned on the central portion 44 of the base wall 20 and is laterally spaced with respect to each other, and the pair of middle holders 100 is positioned between the front holders 98 and the heel holders 96. The toe holders 102 is positioned in the toe portion 40 of the base wall 20.

The base wall 20 is shaped to conform to the bottom surface 24 of the sole 14. The sole 14 has a plurality of recesses 46, each of which extends upwardly through the bottom surface 24 into the sole 14 such that each recess 46 receives one of the plurality of holders 18.

Each one of a plurality of cleats 48 is insertable into the socket 34 of a corresponding one of the plurality of holders 18. Each cleat 48 comprises a housing 50, a retainer 52, a flange 54, and a plurality of prongs 56. The housing 50 is insertable through the corresponding holder 18. The housing 50 has an outer wall 58 and an interior space 60 within the outer wall 58. The housing 50 also has an orifice 62 extending through the outer wall 58 at a bottom end 64 of the housing 50 and an opening 66 extending through the outer wall 58 into the interior space 60 at a lateral side 68 of the housing 50.

The retainer 52 is coupled to and positioned within the housing 50. The retainer 52 is spring biased to engage the corresponding holder 18. The retainer 52 includes a button 70 which is positioned within the housing 50 and extends through the orifice 62 of the housing 50. The button 70 is biased in an engagement position 72 and is movable upwardly to be positioned in a release position 74. The retainer 52 also includes a ball 76 which is positioned such that only a portion of the ball 76 extends through the opening 66 of the housing 50. The opening 66 is shaped such that the ball 76 is retained in the interior space 60. The corresponding holder 18 has a pair of apertures 78, each of which extends inwardly through the elongated tubular wall 30 of the corresponding holder 18. The button 70 is shaped to engage the ball 76 when the button 70 is in the engagement position 72 such that the ball 76 extends through one of the pair of apertures 78 to engage the elongated tubular wall 30. The button 70 is also shaped to permit movement of the ball 76 away from the one of the pair of apertures 78 when the button 70 is positioned in the release position 74.

The flange 54 is coupled to the bottom end 64 of the housing 50 and extends outwardly from the housing 50. The plurality of prongs 56 is peripherally arranged on the flange 54, and each prong 56 extends downwardly from the housing 50 for inserting into a ground surface.

A removal tool 80 is provided for removal of a selected one of the plurality of cleats 48. The removal tool 80 comprises a head 82, a rod 84, and a grip 86. The head 82 has a first end 88 and a second end 90 and is planar. The head 82 has a cavity 92 extending into the first end 88 such that the housing 50 of the selected cleat 48 is positionable within the cavity 92 when the head 82 is positioned between the base wall 20 of the bracket 16 and the flange 54 of the selected cleat 48. The rod 84 is coupled to the second end 90 of the head 82 and extends away from the head 82. The rod 84 is oriented perpendicularly to the head 82. The grip 86 is coupled to a distal end 94 of the rod 84 with respect to the head 82.

In use, the shoe 12 is worn by the user without the bracket 16 and cleats 48 for conventional use outside of a sport. The sole 14 of the shoe 12 functions conventionally to cushion the user as the user steps. The bracket 16 is attached to the shoe 12 with the cleats 48 for use during participation in a sport such as golf where the user wants improved grip on the ground surface. The rigidity of the bracket 16 maintains the cleats 48 in fixed positions relative to each other. If one of the cleats 48 needs to be removed, for example, for maintenance or replacement, it is removed individually from the bracket 16. The button 70 on the cleat 48 to be removed is moved to the release position 74 and the cleat 48 is pulled away from the bracket 16. The head 82 of the removal tool 80 may be wedged between the flange 54 of the cleat 48 and the bracket 16 during this process to assist with removal.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sports footwear assembly comprising:

a shoe having a sole, said sole comprising a resiliently deformable and slip resistant material;

a bracket being coupled to said sole, said bracket extending downwardly from said sole, said bracket comprising a rigid material, said bracket being more rigid than said sole, said bracket having a base wall extending along a bottom surface of said sole;

a plurality of holders, each said holder being coupled to said base wall, each said holder comprising an elongated tubular wall extending upwardly from said base wall of said bracket, said base wall having a plurality of holes, each said hole aligning with an associated holder of said plurality of holders to define a socket of said associated holder;

a plurality of cleats, each said cleat being insertable into said socket of a corresponding one of said plurality of holders, each said cleat extending downwardly for inserting into a ground surface; and wherein each said cleat comprises:

a housing being insertable through said corresponding holder, said housing having an outer wall and having an interior space within said outer wall;

a retainer being coupled to and positioned within said housing, said retainer being spring biased to engage said corresponding holder;

a flange being coupled to said bottom end of said housing and extending outwardly from said housing; and a plurality of prongs being peripherally arranged on said flange, each said prong extending downwardly from said housing for inserting into the ground surface.

2. The assembly of claim 1, wherein said resiliently deformable and slip resistant material is rubber.

3. The assembly of claim 1, wherein said bracket further comprises a lip, said lip being coupled to a peripheral edge of said base wall of said bracket, said lip extending upwardly from said base wall to engage a peripheral surface of said sole such that said bracket is removable from said sole.

4. A sports footwear assembly comprising:

a shoe having a sole, said sole comprising a resiliently deformable and slip resistant material;

a bracket being coupled to said sole, said bracket extending downwardly from said sole, said bracket comprising a rigid material, said bracket being more rigid than said sole, said bracket having a base wall extending along a bottom surface of said sole;

a plurality of holders, each said holder being coupled to said base wall, each said holder comprising an elongated tubular wall extending upwardly from said base wall of said bracket, said base wall having a plurality of holes, each said hole aligning with an associated holder of said plurality of holders to define a socket of said associated holder:

a plurality of cleats, each said cleat being insertable into said socket of a corresponding one of said plurality of holders, each said cleat extending downwardly for inserting into a ground surface; and wherein said base wall has a heel portion being positioned at a heel end of said shoe, said base wall having a toe portion being positioned at a toe end of said shoe, said base wall having a central portion being positioned between said heel portion and said toe portion, said plurality of holders including:

a pair of heel holders, each said heel holder being positioned on said heel portion of said base wall and being laterally spaced with respect to each other;

a pair of front holders, each said front holder being positioned on said central portion of said base wall and being laterally spaced with respect to each other;

a pair of middle holders, each said middle holder being positioned on said central portion of said base wall and being laterally spaced with respect to each other, said pair of middle holders being positioned between said front holders and said heel holders; and a toe holder being positioned in said toe portion of said base wall.

5. A sports footwear assembly comprising:

a shoe having a sole, said sole comprising a resiliently deformable and slip resistant material;

a bracket being coupled to said sole, said bracket extending downwardly from said sole, said bracket comprising a rigid material, said bracket being more rigid than said sole, said bracket having a base wall extending along a bottom surface of said sole;

a plurality of holders, each said holder being coupled to said base wall, each said holder comprising an elongated tubular wall extending upwardly from said base wall of said bracket, said base wall having a plurality of holes, each said hole aligning with an associated holder of said plurality of holders to define a socket of said associated holder;

a plurality of cleats, each said cleat being insertable into said socket of a corresponding one of said plurality of holders, each said cleat extending downwardly for inserting into a ground surface; and wherein said base wall is shaped to conform to said bottom surface of said sole, said sole having a plurality of recesses, each said recess extending upwardly through said bottom surface into said sole, each said recess receiving one of said plurality of holders.

6. The assembly of claim 1, wherein:

said housing of each said cleat has an orifice extending through said outer wall at a bottom end of said housing, said housing having an opening extending through said outer wall into said interior space at a lateral side of said housing; and said retainer of each said cleat comprises:

a button being positioned within said housing and extending through said orifice of said housing, said button being biased in an engagement position, said button being movable upwardly to be positioned in a release position; and a ball being positioned such that only a portion of said ball extends through said opening of said housing, said opening being shaped such that said ball is retained in said interior space, said corresponding holder having a pair of apertures, each said aperture extending inwardly through said elongated tubular wall of said corresponding holder, said button being shaped to engage said ball to extend through one of said pair of apertures to engage said elongated tubular wall, said button being shaped to permit movement of said ball away from said one of said pair of apertures when said button is positioned in said release position.

7. The assembly of claim 1, further comprising a removal tool for removal of a selected one of said plurality of cleats, said removal tool comprising a head having a first end and a second end, said head being planar, said head having a cavity extending into said first end such that said housing of said selected cleat is positionable within said cavity when said head is positioned between said base wall of said bracket and said flange of said selected cleat.

8. The assembly of claim 7, wherein said removal tool further comprises a rod being coupled to said second end of said head, said rod extending away from said head; and a grip being coupled to a distal end of said rod with respect to said head.

9. The assembly of claim 8, wherein said rod of said removal tool is oriented perpendicularly to said head.

10. The assembly of claim 1, further comprising:

said resiliently deformable and slip resistant material being rubber;

said bracket having a lip, said lip being coupled to a peripheral edge of said base wall of said bracket, said lip extending upwardly from said base wall to engage a peripheral surface of said sole such that said bracket is removable from said sole, said base wall having a heel portion being positioned at a heel end of said shoe, said base wall having a toe portion being positioned at a toe end of said shoe, said base wall having a central portion being positioned between said heel portion and said toe portion;

said plurality of holders including:

a pair of heel holders, each said heel holder being positioned on said heel portion of said base wall and being laterally spaced with respect to each other;

a pair of front holders, each said front holder being positioned on said central portion of said base wall and being laterally spaced with respect to each other;

a pair of middle holders, each said middle holder being positioned on said central portion of said base wall and being laterally spaced with respect to each other, said pair of middle holders being positioned between said front holders and said heel holders; and a toe holder being positioned in said toe portion of said base wall;

said base wall being shaped to conform to said bottom surface of said sole, said sole having a plurality of recesses, each said recess extending upwardly through said bottom surface into said sole, each said recess receiving one of said plurality of holders;

each said cleat comprising:

said housing having an orifice extending through said outer wall at a bottom end of said housing, said housing having an opening extending through said outer wall into said interior space at a lateral side of said housing; and a retainer being coupled to and positioned within said housing, said retainer being spring biased to engage said corresponding holder, said retainer comprising:

a button being positioned within said housing and extending through said orifice of said housing, said button being biased in an engagement position, said button being movable upwardly to be positioned in a release position; and a ball being positioned such that only a portion of said ball extends through said opening of said housing, said opening being shaped such that said ball is retained in said interior space, said corresponding holder having a pair of apertures, each said aperture extending inwardly through said elongated tubular wall of said corresponding holder, said button being shaped to engage said ball to extend through one of said pair of apertures to engage said elongated tubular wall, said button being shaped to permit movement of said ball away from said one of said pair of apertures when said button is positioned in said release position; and a removal tool for removal of a selected one of said plurality of cleats, said removal tool comprising:

a head having a first end and a second end, said head being planar, said head having a cavity extending into said first end such that said housing of said selected cleat is positionable within said cavity when said head is positioned between said base wall of said bracket and said flange of said selected cleat;

a rod being coupled to said second end of said head, said rod extending away from said head, said rod being oriented perpendicularly to said head; and a grip being coupled to a distal end of said rod with respect to said head.

* * * * *